US006529698B1

(12) United States Patent
Nagata

(10) Patent No.: US 6,529,698 B1
(45) **Date of Patent: *Mar. 4, 2003**

(54) IMAGE FORMING APPARATUS FEATURING A VARIABLE TONER RETURN BIAS APPLYING TIME

(75) Inventor: Naohisa Nagata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/691,170

(22) Filed: Oct. 19, 2000

(30) Foreign Application Priority Data

Oct. 22, 1999 (JP) ..... 11-301247

(51) Int. Cl.[7] ..... G03G 15/00
(52) U.S. Cl. ..... 399/148; 399/149; 399/176
(58) Field of Search ..... 399/148, 149, 399/150, 174, 176

(56) References Cited

U.S. PATENT DOCUMENTS 5,517,289 A 5/1996 Ito et al. ..... 355/269
5,765,076 A * 6/1998 Ogata et al. ..... 399/149 X
5,835,821 A * 11/1998 Suzuki et al. ..... 399/174 X
5,873,013 A 2/1999 Matsushita et al. ..... 399/100
5,937,245 A * 8/1999 Inoue et al. ..... 399/150 X
5,999,773 A * 12/1999 Yasutomi et al. ..... 399/148
6,002,907 A * 12/1999 Berkes ..... 399/148 X
6,215,967 B1 * 4/2001 Takeda et al. ..... 399/148 X

FOREIGN PATENT DOCUMENTS

JP 9-50161 2/1997
JP 10-221932 8/1998
JP 11-52748 2/1999

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member and a charging device for charging the image bearing member. An electrostatic image forming device selectively removes charges on the image bearing member charged by the charging device to form an electrostatic image. A developing device develops the electrostatic image with toner as a toner image. The toner image on the image bearing member is transferred by a transfer device onto a transfer material. The charging device temporarily collects residual toner after transferring the toner image. A return bias applying device applies a return bias for returning the toner collected in the charging device to the image bearing member in a nonimage forming period. The length of a return bias applying time period of the return bias applying device is variably controlled by a controller.

5 Claims, 7 Drawing Sheets

FIG. 6

| VIDEO COUNT INTEGRATED VALUE OF PREVIOUS 25 SHEETS / ENDURANCE LEVEL VALUE E V25 | 0 TO 35000000 | TO 88000000 | TO 170000000 | TO 260000000 | TO 440000000 | TO 620000000 | FROM 620000001 |
|---|---|---|---|---|---|---|---|
| 0 TO 500 | 0 | 0 | 0 | 0 | 0 | 0 | 6 |
| TO 1000 | 0 | 0 | 0 | 0 | 2 | 5 | 8 |
| TO 1500 | 0 | 0 | 0 | 2 | 5 | 8 | 10 |
| TO 2000 | 0 | 0 | 2 | 5 | 8 | 10 | 12 |
| FROM 2001 | 0 | 2 | 4 | 6 | 8 | 10 | 15 |

UNIT : SECOND

IMAGE FORMING APPARATUS FEATURING A VARIABLE TONER RETURN BIAS APPLYING TIME

BACKGROUND OF THE INVENTION

1. Field of the Invention

The present invention relates to an image forming apparatus such as a copying machine, a printer and the like, utilizing an electrophotographic system or an electrostatic recording system.

2. Related Background Art

Image forming apparatuses utilizing an electrophotographic system are well-known. In an image forming process of such an apparatus, after a surface of a photosensitive drum as a latent image bearing member is uniformly charged by a charging device, an electrostatic latent image is formed on the photosensitive drum by a laser or an LED. Then, the electrostatic latent image is developed with toner as developer to form a toner image which is in turn transferred onto a recording material as a recording medium such as paper.

In color image formation, the above-mentioned process is repeated for magenta, cyan, yellow and black colors, and color toner images superimposed on the recording material is fixed to the recording material by heat to form a color image. During this process, after the transferring, residual toner remaining on the photosensitive drum is removed by an exclusive cleaning apparatus.

By the way, recently, a reduction in cost and compactness of the apparatus have been requested. To this end, a so-called cleaner-less image forming apparatus in which such a cleaning apparatus is not provided around the latent image bearing member has been proposed.

In such a cleaner-less image forming apparatus, after the transferring, in order to remove the residual toner remaining on the photosensitive drum (referred to as "transfer-residual toner" hereinafter), for example, there has been proposed a method in which, after the transferring, a small amount of toner remaining on the photosensitive drum is once received by the charging device as charging means of contact type to change the electrostatic property and then the toner is returned to the photosensitive drum again, and, thereafter, the toner is collected by a developing apparatus also acting as collecting means to use the toner again. By this method, the residual toner on the surface of the photosensitive drum is removed and collected in a sheet-to-sheet interval during the print job or within a predetermined time period after the print job. Such a method is described in the Applicant's U.S. Pat. No. 6,215,967.

However, in such an image forming apparatus, during continuous printing of images having high density, an amount of transfer-residual toner is increased, with the result that the process for returning the toner to the photosensitive drum may not completely follow the process for receiving the residual toner once by the charging device. In such a case, within the charging device, the toner is mixed with a ferrite carrier as a low resistance carrier forming a dielectric brush. If the amount of toner is greatly increased in the charging device, the surface of the photosensitive drum cannot be uniformly charged with a predetermined potential, with the result that desired image density may not be achieved.

Further, even when images having the same density are printed, in the charging device which has once been used, efficiency of toner discharging process will be worsened, in comparison with a new charging device.

In addition, even when only images having low density are printed, in dependence upon the environment, a small amount of toner may be gradually accumulated in the charging device, thereby worsening the charging ability.

SUMMARY OF THE INVENTION

An object of the present invention is to provide an image forming apparatus in which collection and discharging of toner can be effected without worsening a charging ability of a charging device.

Another object of the present invention is to provide an image forming apparatus in which a discharging time from charging means can be altered.

A further object of the present invention is to provide an image forming apparatus comprising an image bearing member, charging means for charging the image bearing member, electrostatic image forming means for selectively removing charges on the image bearing member charged by the charging means to form an electrostatic image with toner as a toner image, transfer means for transferring the toner image on the image bearing member onto a transfer material (the charging means temporarily collecting residual toner after the transferring), return bias applying means for applying a return bias for returning the toner collected in the charging means to the image bearing member in a nonimage forming period, and control means for controlling a return bias applying time period of the return bias applying means.

The other objects and features of the present invention will be apparent from the following detailed explanation referring to the accompanying drawings.

BRIEF DESCRIPTION OF THE DRAWINGS

FIG. 6 is a table for determining a residual developer removing time in the embodiment of the present invention.

DETAILED DESCRIPTION OF THE PREFERRED EMBODIMENTS

The present invention will now be fully explained in connection with embodiments thereof with reference to the accompanying drawings.

Figure 1:
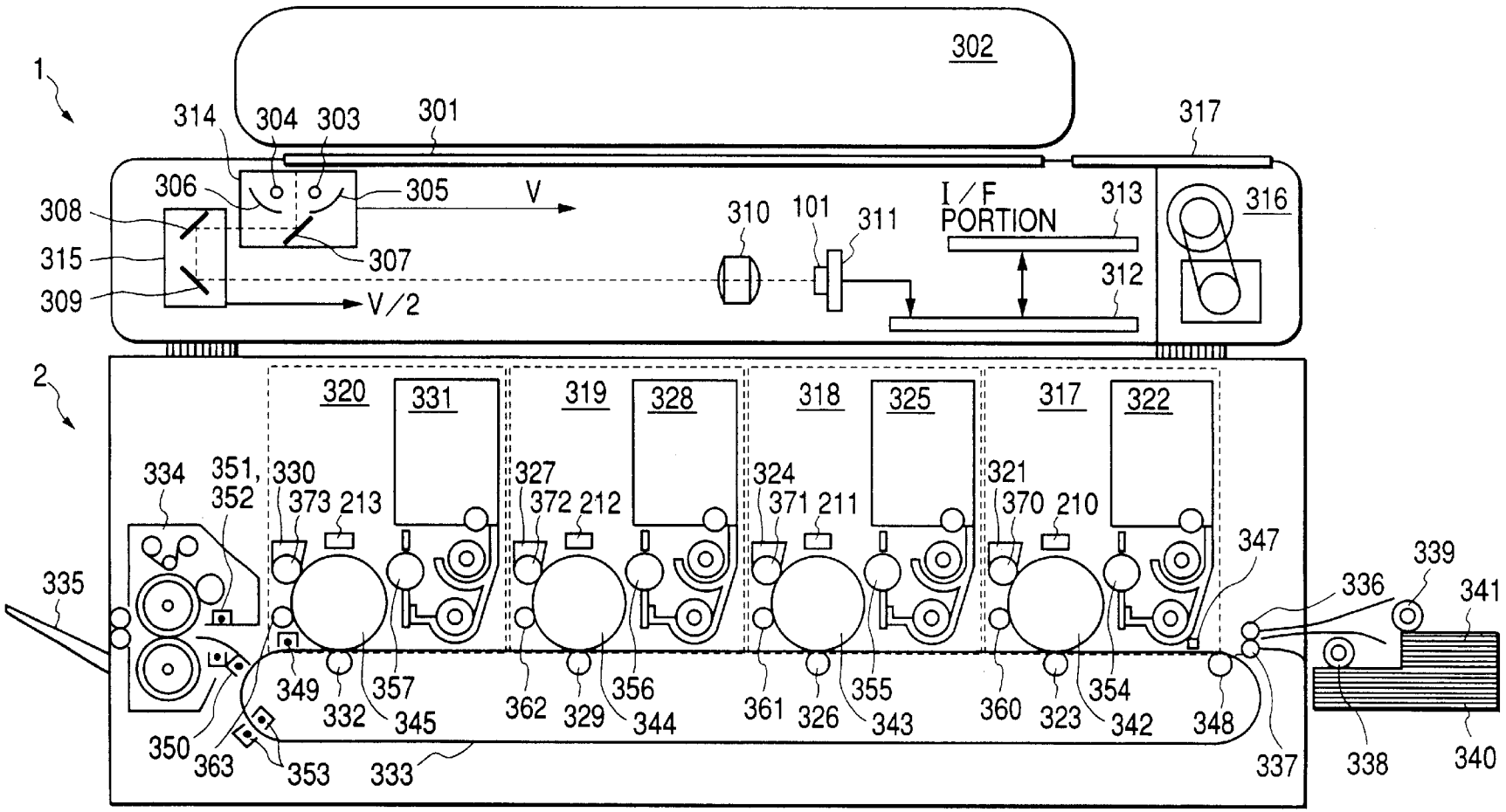
FIG. 1 is a sectional view showing a schematic construction of a color image forming apparatus as an example of an image forming apparatus according to an embodiment of the present invention.

FIG. 1 is a sectional view showing a schematic construction of a color image forming apparatus as an example of an image forming apparatus according to an embodiment of the present invention.

Such a color image forming apparatus includes a color reader portion 1 and a color printer portion 2.

First of all, the color reader portion 1 will be described.

In the color reader portion 1, as shown in FIG. 1, an original resting glass (platen) 301 is located at an upper portion, and an original feeding apparatus (DF) 302 is provided above the original resting glass. Incidentally, in place of the original feeding apparatus 302, a mirror surface pressing plate may be mounted. Within a first carriage 314, there are mounted light sources 303 and 304 as halogen lamps, reflection hoods 305 and 306 for collecting lights from the light sources 303 and 304 onto the original, and a reflection mirror 307 for reflecting reflection light or projection light from the original. Further, within a second carriage 315, there are mounted mirrors 308 and 309 for collecting the reflection light from the mirror 307 onto a CCD 101.

Figure 2:
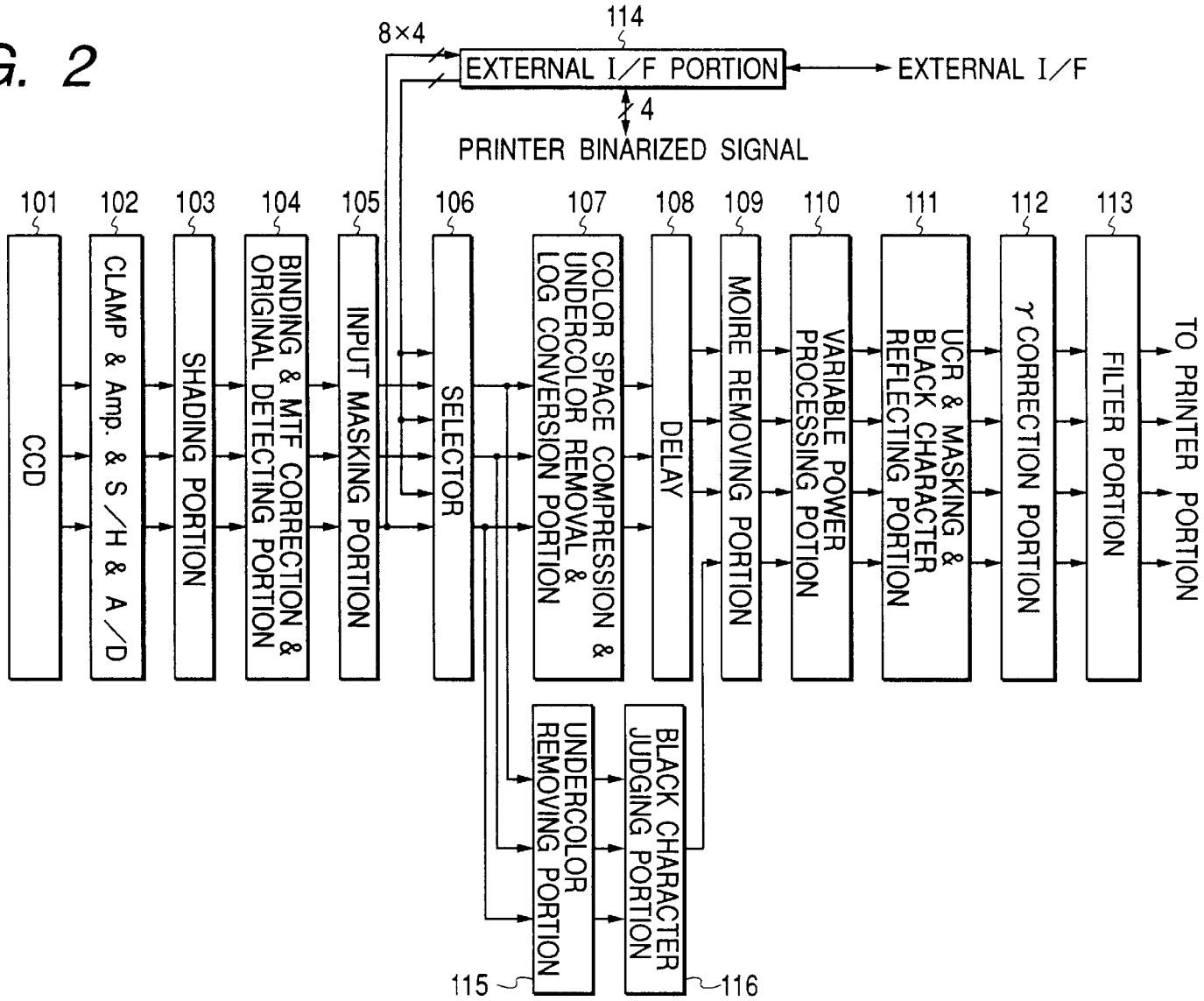
FIG. 2 is a block diagram showing a construction of a digital image processing portion in the embodiment of the present invention.
Figure 3:
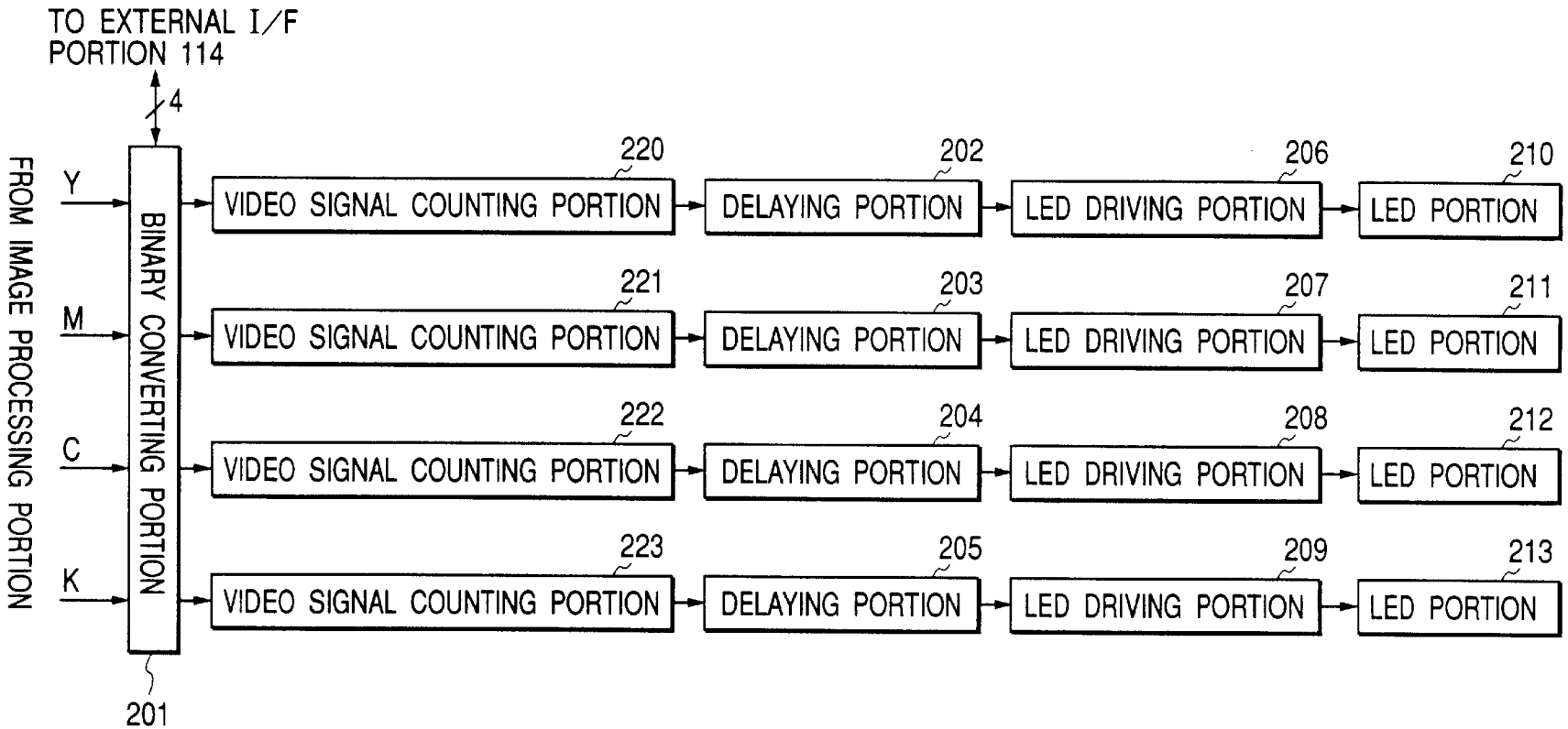
FIG. 3 is a block diagram showing a construction of an LED driving portion in the embodiment of the present invention.

The color reader portion 1 further comprises a digital image processing portion (referred to as "image processing portion" hereinafter) 312 including a substrate 311 on which the CCD 101 is mounted, elements shown in FIG. 2 other than the CCD 101, and a binary value converting portion 201 and delay portions 202, 203 and 204 as shown in FIG. 3, and an interface (I/F) portion 313 to other elements such as an IPU.

Incidentally, the first carriage 314 and the second carriage 315 are mechanically shifted at speeds of V and V/2, respectively by driving means 316 in a direction perpendicular to an electrical scanning direction (main scanning direction) of the CCD 101, thereby scanning (sub-scanning) the entire surface of the original.

FIG. 2 is a block diagram showing the image processing portion 312 in detail.

In the image processing portion 312, as shown in FIG. 2, the lights from the light sources 303 and 304 are reflected by the original rested on the original resting glass 301, and the reflected lights are directed to the CCD 101, where the lights are converted into electric signals. Incidentally, in the case of a color sensor, the CCD 101 may be constituted so that R (red), G (green) and B (blue) color filters are arranged in-line CCD in the order of R, G and B or may be constituted so that the R filter, G filter and B filter are arranged on three CCDs, respectively or may be constituted so that the filters are designed as on-chip or the filters are provided independently of the CCDs.

The electric signals (analogue image signals) are inputted to the image processing portion 312, sample hold (S/H) is effected in a clamp & Amp. & S/H & A/D portion 102, so that dark levels of the analogue image signals are clamped to reference potentials and amplified to predetermined amounts (processing order is not necessarily the above-mentioned order) and A/D-converted thereby to be converted into R, G and B 8-bit digital signals, for example.

Then, shading correction and black correction of the R, G and B signals are effected in a shading portion 103. In the case where the CCD 101 is three-line CCD, since reading positions between lines are different regarding a binding process, then, in a binding & MTF correction & original detecting portion 104, delay amounts of respective line are adjusted in accordance with reading speeds to correct signal timing so that the reading positions of three lines become equal. Further, regarding MTF correction, since MTF readings are changed in accordance with the reading speeds and variable power rates, which changes are corrected. Further, a size of the original on the original resting glass is ascertained by original detection.

The digital signals the reading position timings of which are corrected are inputted to an input masking portion 105, where a spectral property of the CCD 101 and spectral properties of the light sources 303, 304 and the reflection hoods 305, 306 are corrected. Output from the input masking portion 105 is inputted to a selector 106 which can be switched to an external I/F signal.

The signals inputted to the undercolor removing portion 115, where undercolor is removed, are then inputted to a black character judging portion 116 for judging whether characters on the original are black, where a black character signal is formed from the original. Further, in the color space compression & undercolor removal & LOG conversion portion 107 into which the output of the selector 106 was inputted, by color space compression, it is judged whether the read image signals are within a range in which the image signals can be reproduced by the printer. If the signals are within such a range, the signals are not processed; whereas, if the signals are not within such a range, the signals are corrected so that the signals fall within the range in which the image signals can be reproduced by the printer. Then, the undercolor removing process is performed, and, by LOG conversion, the R, G and B signals are converted into C (cyan), M (magenta) and Y (yellow) signals.

In order to correct the signal formed in the black character judging portion 116 and the timing, the output signals from the color space compression & undercolor removal & LOG conversion portion 107 are inputted to a delay portion 108, where the timing is adjusted. The two kinds of signals are inputted to a moire removing portion 109, where moire is removed. Then, the signals are inputted to a variable power processing portion 110, where variable power processing is effected in the main scanning direction.

In an UCR & masking & black character reflecting portion 111, regarding the signals processed in the variable power processing portion 110, C, M, Y and K (black) signals are formed from the C, M and Y signals by UCR processing, and the signals are corrected to signals suitable for the output of the printer by masking processing, and the judging signal formed in the black character judging portion 116 is fed-back to the C, M, Y and K signals.

The signals processed in the UCR & masking & black character reflecting portion 111 are inputted to a γ correction portion 112, where density is adjusted. Then, in a filter portion 113, smoothing or edge processing is effected.

The signals processed in this way are inputted to a binary converting portion 201 shown in FIG. 3, where 8-bit multi-value signals are converted into binary signals. Incidentally, this converting method may be a deza method, an error diffusing method or an improved error diffusion method.

Next, the color printer portion 2 will be explained.

As shown in FIG. 1, the color printer portion 2 comprises a Y image forming portion 317, an M image forming portion 318, a C image forming portion 319 and a K image forming portion 320, and these portions include photosensitive drums 342, 343, 344 and 345 as latent image bearing members, chargers 321, 324, 327 and 330 as charging means, LED portions 210, 211, 212 and 213 developing devices 322, 325, 328 and 331 also acting as collecting means, and auxiliary chargers 360, 361, 362 and 363 respectively. Further, the chargers 321, 324, 327 and 330 have charging sleeves 370, 371, 372 and 373 respectively, and the developing devices 322, 325, 328 and 331 have developing sleeves 354, 355, 356 and 357, respectively.

Incidentally, since constructions of the M image forming portion 318, C image forming portion 319 and K image forming portion 320 are the same as that of the Y image forming portion 317, an explanation thereof will be omitted.

The Y image forming portion 317 has the photosensitive drum 342 around which the charger 321, LED portion 210, developing device 322 and auxiliary charger 360 are arranged.

Figure 4:
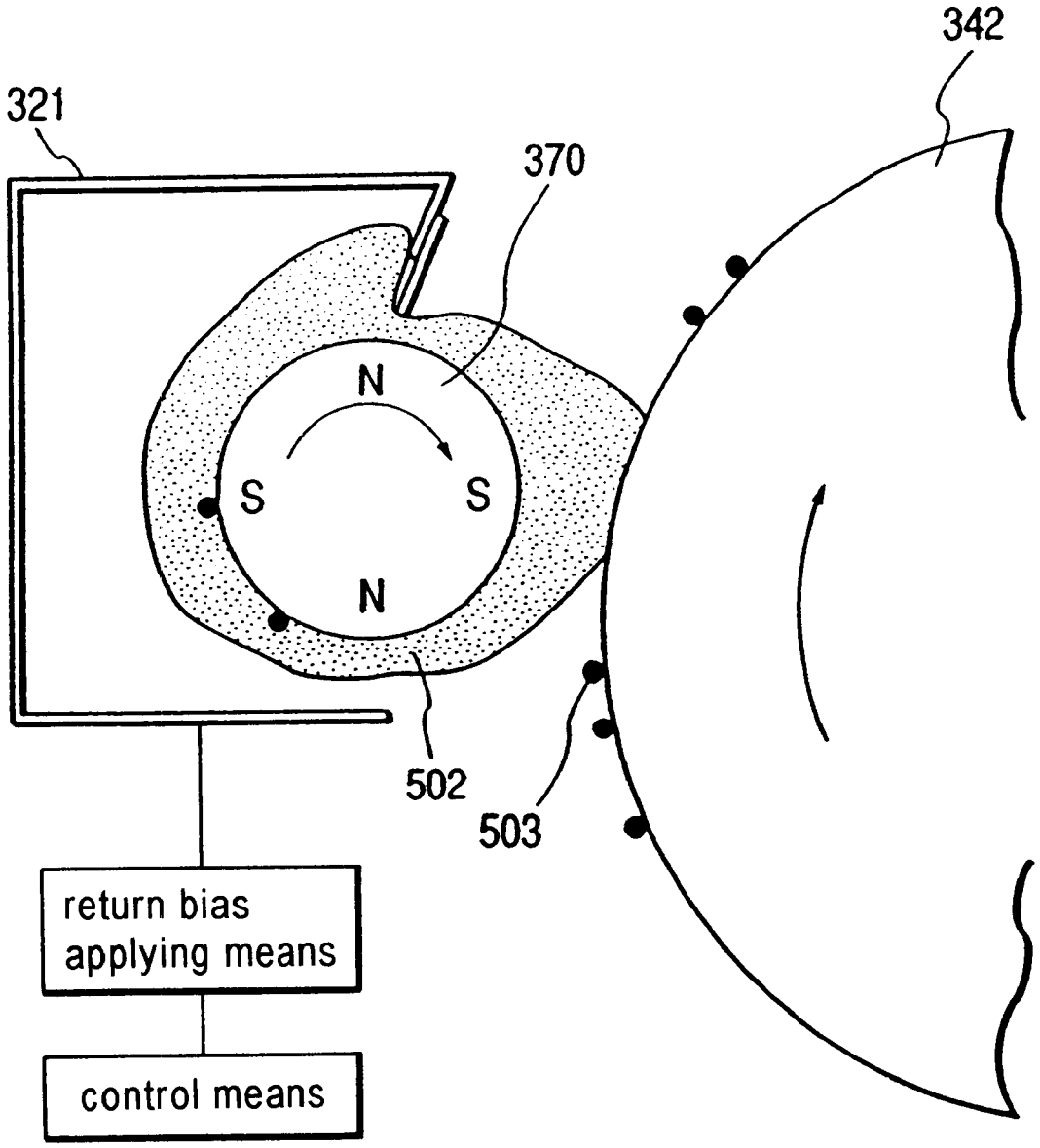
FIG. 4 is a sectional view showing a construction of charging means provided in the color image forming apparatus of FIG. 1.

In operation, first of all, the surface of the photosensitive drum 342 is charged by the auxiliary charger 360 and the charger 321. As shown in FIG. 4, in the charger 321, by rotating the charging sleeve 370 as a rotary member in a direction opposite to a rotational direction of the photosensitive drum 342, a dielectric brush is formed from ferrite carrier 502 as low resistance carrier contained in a container (not shown), by which the surface of the photosensitive drum 342 is uniformly charged, thereby preparing for formation of the latent image.

Then, the latent image is formed on the surface of the photosensitive drum 342 by light from the LED array 210 and then is developed by the developing device 322 to form a toner image.

Incidentally in the developing device 322, development is effected by applying developing bias between the photosensitive drum 342 and the developing sleeve 354.

A transfer charger 323 urged against the photosensitive drum 342 with the interposition of a transfer belt 333 as transfer means below the developing device 322 effects discharging from the back side of the transfer belt 333, with the result that the toner image on the photosensitive drum 342 is transferred onto a recording paper on the transfer belt 333.

After the transferring, toner 503 remaining on the photosensitive drum 342 is once received by the charger 321 to change the electrostatic property of the photosensitive drum. Thereafter, the toner is returned to the photosensitive drum 342 again and then is collected by the developing device 322.

Next, a sequence for forming the image on the recording paper will be explained.

Recording papers contained in a cassette 340 or 341 are fed one by one onto the moving transfer belt 333 by a pick-up roller 338 or 339 and sheet feeding rollers 336, 337. The transfer belt 333 is shifted by a transfer belt roller 348 disposed below the Y image forming portion 317, M image forming portion 318, C image forming portion 319 and K image forming portion 320.

A leading end of the recording paper fed to the transfer belt 333 is detected by a sheet leading end sensor 347. A detection signal from the sheet leading end sensor is sent from the color printer portion 2 to the color reader portion 1 and is used as a subscanning synchronous signal when the video signal is sent from the color reader portion 1 to the color printer portion 2.

Thereafter, the recording paper is conveyed by the transfer belt 333, and the toner images are successively formed on the recording paper in the image forming portions 317 to 320 in the order of Y, M, C and K.

After the recording paper is passed through the K image forming portion 320, electricity is removed from the recording paper by an electricity removing charger 349 in order to facilitate the separation of the recording paper from the transfer belt 333. Then, the recording paper is separated from the transfer belt 333. In this case, a peeling charger 350 disposed adjacent to the electricity removing charger 349 prevent distortion of the image due to peel discharging generated when the recording paper is separated from the transfer belt 333.

The separated recording paper is charged by prefixing chargers 351 and 352 to promote a toner attracting force thereby to prevent the image distortion. Thereafter, the toner images are thermally fixed to the recording paper by a fixing device 334. Then, the recording paper is discharged onto a sheet discharge tray 335. Further, electricity is removed from the transfer belt 333 by inner and outer electricity removing chargers 353.

Next, the LED image recording will be explained with reference to FIG. 3.

In FIG. 3, the signals from the image processing portion are binarized in the binary converting portion 201 and then are sent to video signal counting portions 220 to 223 as image information detecting means. In the video signal counting portions 220 to 223, the total numbers of the LEDs being illuminated are counted for the respective color images.

Thereafter, the binarized image signal are inputted to delay portions 202, 203, 204 and 205 where the signals are delayed in accordance with respective image forming positions and the sheet leading end sensor 347, respectively. Then, the signals are sent to LED drivers 206, 207, 208 and 209. The LED driving portion 206, 207, 208 and 209 serve to form or generate signals for driving LED portions 210, 211, 212 and 213.

Next, control for interrupting the print job and for controlling length of return bias applying time for returning the toner from the charger to the photosensitive drum, which is a characteristic portion of the present invention, will be explained.

In the illustrated embodiment, the return bias applying time period is determined in accordance with an endurance level value sought from an image density total value from the initial condition of the image bearing member and from a count total value, and an image density total value between predetermined number count values obtained by number measuring means (not shown).

According to the illustrated embodiment, first of all, in the image formation of each image during the print job, the image density is detected. Here, as the image density for each color image, the total number of illuminated LEDs counted in the video count portion 220, 221, 222 or 223 as video counting means shown in FIG. 3.

Figure 5:
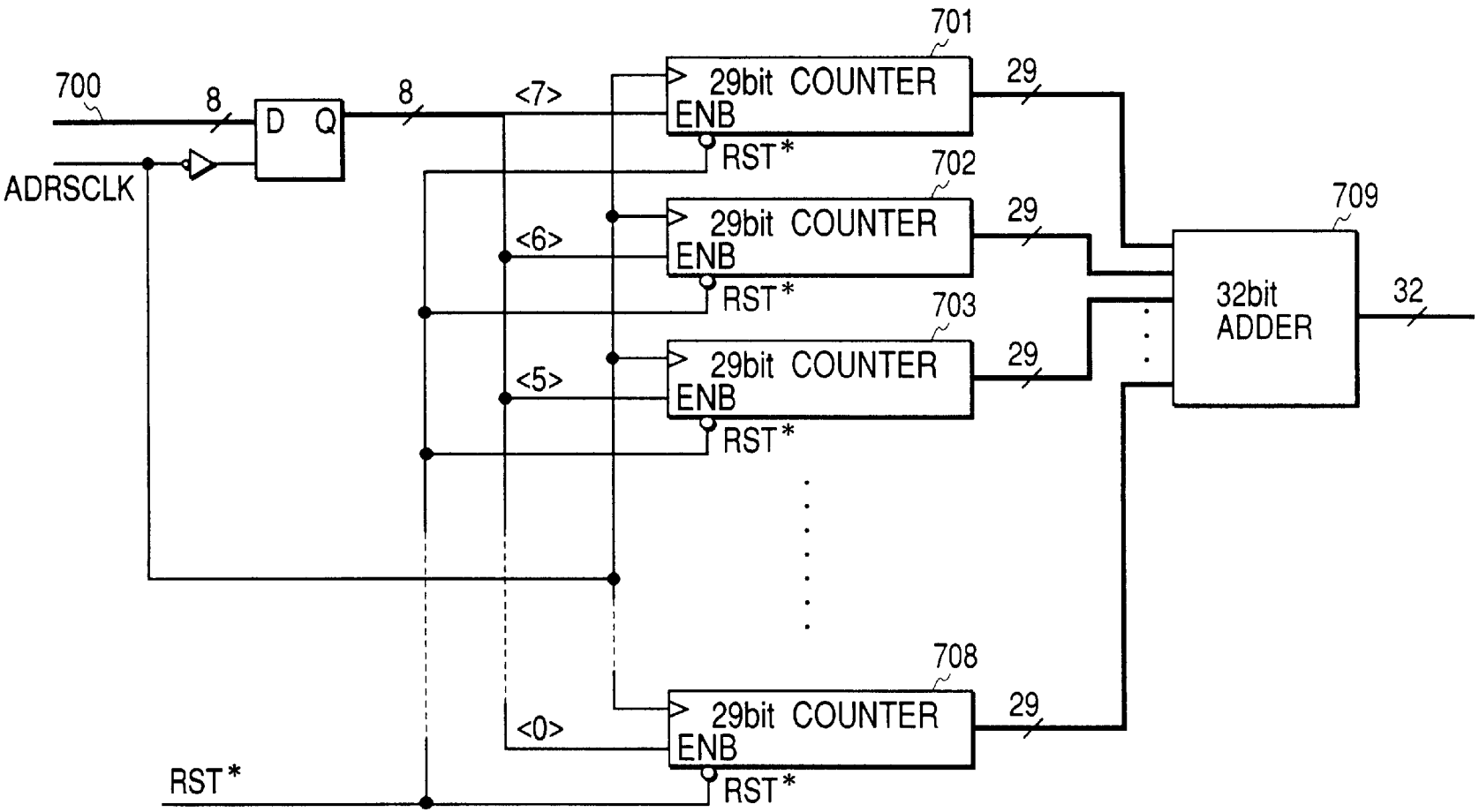
FIG. 5 is a block diagram showing a construction of a video signal count portion in the embodiment of the present invention.

FIG. 5 shows the video signal count portion 220 in detail. Incidentally, the video signal count portions 221 to 223 have the same constructions as that of the video signal count portion 220.

In the video signal count portion 220, first of all, the image signal 700 sent from the binary converting portion 201 is counted by 29-bit counters 701 to 708 in parallel for each 8-bit as an image signal for one image, and counted results are added to each other by a 32-bit adder 709, thereby obtaining the total number of illuminated LEDs as 32-bit data.

Such processing is effected for each image formation to seek the total number of illuminated LEDs (referred to as "video count" hereinafter), and a value obtained by successively adding the total numbers from the initial condition of the photosensitive drum 342 upon installation of the apparatus is regarded as $V_{sum}$. Further, a value (calculated in terms of A4 sheet size) obtained by successively adding the image formation numbers from the initial condition of the photosensitive drum 342 upon installation of the apparatus is regarded as $N_{sum}$.

When it is assumed that the sheet number corresponding to the service life of the drum is D and the video count value for A4 size solid print is $V_{A4}$, the endurance level value E is sought from the following equation:

$$E=(N/D)\times(V_{sum}/V_{A4}).$$

Then, by using the endurance level value E and a video count total value $V_{25}$ for previous 25 sheets, from a table shown in FIG. 6, a time period T1 for removing the residual toner. As shown in FIG. 6, since the higher the printed image density the greater the value $V_{25}$ and the longer the endurance time the greater the endurance level value E, the time period for removing the residual toner by returning the toner from the charge to the photosensitive drum becomes longer.

Further, when the total image formation number becomes 500 (sheets) from the previous removal of residual toner during the interruption of the job, a time period T2 for removing the residual toner is set to 60 seconds.

On the basis of T1 and T2, a time period T for removing the residual toner is sought from the following equation:

$$T=T1+T2.$$

Figure 7:
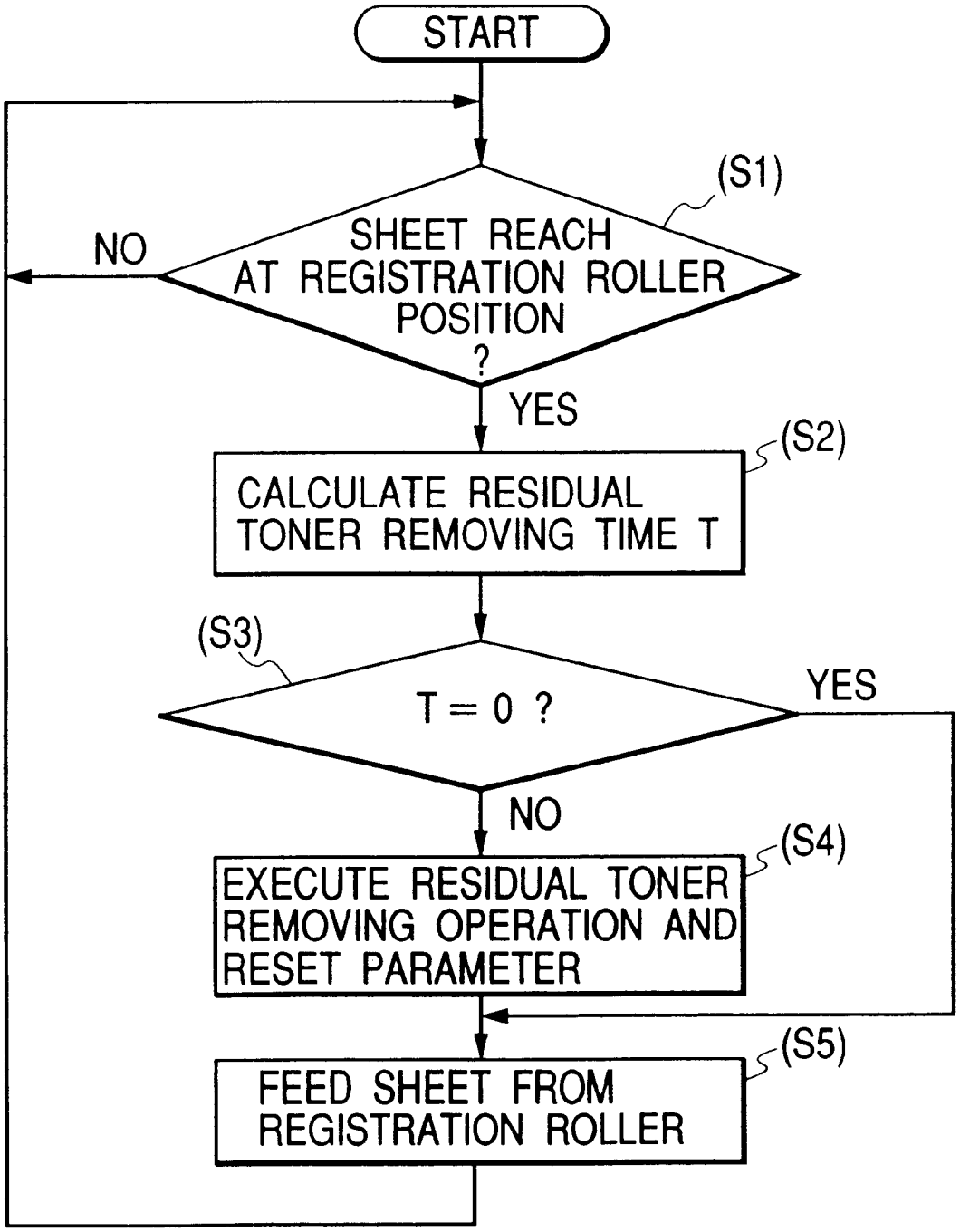
FIG. 7 is a flowchart for explaining residual developer removing control in the embodiment of the present invention.

Next, a method for removing the residual toner during the interruption of the job will be explained with reference to FIG. 7.

In a step S1, if the fact that the sheet reaches a registration roller position is detected, in a step S2, the time period T for removing the residual toner is sought in the above-mentioned manner. Then, in a step S3, it is judged whether T=0, i.e., whether the removal of the residual toner is executed or not. If T=0, in a step S5, the sheet is fed from the registration rollers at a predetermined timing; whereas, if T≠0 (T is not 0), while the feeding of the sheet is being stopped at the registration roller position, in a step S4, the residual toner removing operation is carried out. In this operation, DC of −700 V and AC bias having a rectangular wave of 1.1 $kV_{pp}$, 1 kHz and 50% duty are applied to the charger associated with the rotating photosensitive drum and the developing sleeve is driven, and DC of −550 V and AC bias having a rectangular wave of 1 $kV_{pp}$, 2.2 kHz and 60% duty are applied to the developing device and the developing sleeve is driven. As a result, the charger once receives the toner on the photosensitive drum to change the electrostatic property and then returns the toner to the photosensitive drum again, and, thereafter, the developing device collects the toner. After this operation is performed by the time period T, the video count total value $V_{25}$ for previous 25 sheets and the image formation number count value for seeking the value T2 are reset.

In a step S5, the feeding of the sheet waiting at the registration roller position is started and the image formation is effected.

Incidentally, in the illustrated embodiment, while an example that the toner discharged from the charger is collected in the developing device was explained, in this case, by stopping the operation of the developing device, the residual toner may be transferred to the transfer belt and then may be collected by a transfer belt cleaner.

Further, in the illustrated embodiment, while an example that the image density is sought by using the total number of illuminated LEDs was explained, also in an apparatus in which a latent image is formed by a laser, similar control can be performed by using video count.

Further, as a method for seeking the image density, a potential sensor may be provided around the photosensitive drum to measure the potential of the photosensitive drum.

As mentioned above, in the image forming apparatus in which the transfer-residual toner on the latent image bearing member can be removed by the action of the charging means, the transfer-residual developer on the latent image bearing member can be removed and collected without worsening the charging ability of the charging means.

While the present invention was explained in connection with the specific embodiments, the present invention is not limited to such embodiments, but various alterations and modifications can be made within the scope of the invention.

What is claimed is:

1. An image forming apparatus comprising:

an image bearing member;

charging means for charging said image bearing member;

electrostatic image forming means for selectively removing charges on said image bearing member charged by said charging means to form an electrostatic image;

developing means for developing the electrostatic image with toner as a toner image;

transfer means for transferring the toner image on said image bearing member onto a transfer material;

said charging means temporarily collecting residual toner after transferring the toner image;

return bias applying means for applying a return bias for returning the toner collected by said charging means to said image bearing member in a nonimage forming time period; and control means for variably controlling a length of a return bias applying time period of said return bias applying means in accordance with an endurance level of said image forming apparatus.

2. An image forming apparatus according to claim 1, wherein said developing means collects the toner returned from said charging means to said image bearing member.

3. An image forming apparatus according to claim 1, wherein said control means controls the length of the return bias applying time period on the basis of an image information amount and an image formation number.

4. An image forming apparatus according to claim 1, wherein said charging means includes a particle layer slidingly contacted with said image bearing member and the residual toner on said image bearing member is collected within said particle layer.

5. An image forming apparatus according to claim 1, wherein said control means sets the length of the returning bias applying time period to be longer when the endurance level is greater.

* * * * *

UNITED STATES PATENT AND TRADEMARK OFFICE

CERTIFICATE OF CORRECTION

PATENT NO. : 6,529,698 B1 
DATED : March 4, 2003
INVENTOR(S) : Naohisa Nagata

It is certified that error appears in the above-identified patent and that said Letters Patent is hereby corrected as shown below:

Column 3,
Line 60, “line” should read -- lines --.

Column 4,
Line 7, “I/F signal.” should read -- I/F signal. ¶The signals outputted from the selector 106 are inputted to a color space compression and indicator (under color) removal and LOG conversion portion 107 and an undercolor removing portion 115. -- ; and
Line 58, “213 developing” should read -- 213, developing --.

Column 5,
Line 50, “subscanning” should read -- sub-scanning --; and
Line 65, “prevent” should read -- prevents --.

Column 6,
Line 18, “signal” should read -- signals --; and
Line 23, “portion 206,” should read -- portions 206, --.

Signed and Sealed this

Twenty-ninth Day of June, 2004

JON W. DUDAS
*Acting Director of the United States Patent and Trademark Office*